US006478109B1

(12) United States Patent
Kam

(10) Patent No.: US 6,478,109 B1
(45) Date of Patent: Nov. 12, 2002

(54) LAMINATED COMPOSITE PANEL-FORM LOUDSPEAKER

(76) Inventor: Tai-Yan Kam, 4th Fl., No.3, 2nd Alley, 86th Lane, Chien Kung 1st Rd., Hsin Chu 300 (TW)

( * ) Notice: Subject to any disclaimer, the term of this patent is extended or adjusted under 35 U.S.C. 154(b) by 119 days.

(21) Appl. No.: 09/609,688

(22) Filed: Jul. 5, 2000

(51) Int. Cl.[7] ..... G10K 13/00
(52) U.S. Cl. ..... 181/177; 181/175; 181/176
(58) Field of Search ..... 181/166, 177, 181/173, 157, 176, 164, 167, 171, 175

(56) References Cited

U.S. PATENT DOCUMENTS 3,247,925 A * 4/1966 Warnaka ..... 181/31
3,347,335 A 10/1967 Watters et al.
5,629,503 A * 5/1997 Thomasen ..... 181/199
5,635,686 A * 6/1997 Fenton ..... 181/144

FOREIGN PATENT DOCUMENTS

WO WO 92/03024 2/1992
WO WO 97/09842 3/1997

* cited by examiner

*Primary Examiner*—Robert E. Nappi
*Assistant Examiner*—Kim Lockett
(74) *Attorney, Agent, or Firm*—Michael J. Brown

(57) ABSTRACT

A laminated composite panel-form loudspeaker consists of a peripherally stiffened laminated composite radiating panel on which a preselected number of transducers are mounted and a rectangular frame carrying a flexible suspension device which supports the panel radiator. The laminated composite radiating panel comprises a predetermined number of orthotropic laminae with predetermined specific moduli and stacking sequence. The peripheral edge of the laminated composite radiating panel is reinforced with strips of which the rigidities are determined in such a way that beneficial natural normal modes of the radiating panel are excited and satisfactory operation of the panel radiator over a desired acoustic frequency range achieved. The standing waves at the peripheral edge of the stiffened radiating panel are damped out via the use of the flexible suspension device. The transducers are situated at predetermined locations in a preselected feasible region on the panel radiator so that relatively high radiation efficiency and uniform spread of sound intensity spectrum can be produced by the panel radiator over a desired operative acoustic frequency range.

16 Claims, 13 Drawing Sheets

LAMINATED COMPOSITE PANEL-FORM LOUDSPEAKER

FIELD OF THE INVENTION

The invention relates to a panel-form loudspeaker utilizing a sound radiator panel that can generate beneficial vibrational normal modes for radiating sound with desired pressure level over a specific frequency range.

BACKGROUND OF THE INVENTION

Conventional loudspeakers utilizing a cone-type membrane as a sound radiator have been in widespread use. The cone shape radiator which is mechanically driven at its smaller end and in a pistonic manner by a moving coil of electromagnetic means can radiate sound waves from the front and rear of the radiator. In general, an enclosure is necessary to prevent low-frequency waves from the rear of the loudspeaker, which are out of phase with those from the front, from diffracting around to the front and interfering destructively with the waves from the front. The existence of such enclosure makes the loudspeaker possess some disadvantages such as cumbersome, weighty, having dead corner for sound radiation, etc. The shortcomings of conventional loudspeakers have led to the intensive development of panel-form loudspeakers in recent years and many proposals have thus resulted. For instance, Watters used the concept of coincidence frequency, where the speed of sound in panels subject to bending wave action matches the speed of sound in air, to design a light stiff strip element of composite structure that can sustain bending waves and produce a highly directional sound output over a specified frequency range. Heron proposed a panel-form loudspeaker which had a resonant multi-mode radiator panel. The radiator panel which was a skinned composite with a honeycomb core was excited at frequencies above the fundamental and coincidence frequencies of the panel to provide, hopefully, high radiation efficiency through multi-modal motions within the panel. The design of such radiator panel, however, makes it so stiff that it requires a very large and cumbersome moving-coil driver to drive the panel and its overall efficiency from the viewpoint of electrical input is even less than conventional loudspeakers. Furthermore, the operating frequency range of the radiator panel is not wide enough for general purposes and thus only suitable for public address applications. Azima et al proposed a distributed mode method for the design of a panel-form acoustic device which consisted of a panel radiator capable of sustaining bending waves associated with resonant modes in the panel radiator and used transducers to excite the resonant modes of the panel radiator. Their proposed distributed mode method includes analysis of distribution of flexural resonant modes and identification of dead/combined dead-spots of the panel radiator. The transducers are mounted at some particular points on the radiating panel which, hopefully, will not be coincident with the dead/combined dead-spots. Such design, however, is too idealistic to be practical, especially for the design of laminated composite panel radiators. Since for a panel under vibration, there may be several thousand resonant modes with frequencies in the range from 50 to 20 kHz. It thus becomes extremely infeasible or even impossible to identify all dead/combined dead-spots of the panel. In face of this difficulty, they simplified the design process by using only lower orders of resonant modes in the design of panel radiator. The adoption of such simplification in the design of the panel radiator has thus caused the sacrifice of the performance of the loudspeaker. Since only finite number of dead/combined dead-spots on the radiating panel are identified, it is inevitable that the points at which the transducers are mounted will coincide with some of the dead/combined dead-spots of higher resonant modes. It then becomes obvious that the transducers mounted at the dead/combined dead-spots of certain resonant modes will be unable to excite those modes and the intensity of sound radiated from the panel vibrating at the corresponding frequencies will become too low to be acceptable. Their approach in determining the locations of the transducers also creates another shortcoming of the loudspeaker. Due to the existence of over six thousand resonant modes, the transducers will inevitably over-excite certain resonant modes and thus generate undesirable sound intensities or overshoots at the corresponding frequencies. Furthermore, the other major defect existing in their proposal is the interference of sound waves radiated from different regions on the panel radiator. On a vibrating panel, the sound waves radiated from the convex and concave regions on the panel surface are out-of-phase. The sound waves of opposite phase will generate interference among them and thus lower the sound pressure level. In particular, for a panel vibrating with resonant modes in lower frequency range, the interferences among the sound waves of opposite phase may be so severe that they will significantly lower the sound intensities at the corresponding frequencies. The problem of sound level reduction caused by the interference of sound waves of opposite phase, however, was not observed and tackled by the previous proposers. In view of the above disadvantages, it is apparent that the method proposed by Azima et al can only find limited applications on the fabrication of low efficient acoustic devices. As for the design of loudspeakers of high fidelity, their method is still far from reach.

SUMMARY OF THE INVENTION

It is, therefore, a principal object of the present invention to provide a panel radiator for a loudspeaker which can produce a desired sound pressure level spectrum over a predetermined frequency range. The panel radiator for a loudspeaker includes a thin laminated composite radiating plate with stiffened peripheral edge and a preselected number of transducers mounted on the laminated composite plate at specific locations in a predetermined feasible region. The laminated composite radiating plate, which consists of a preselected number of orthotropic laminae with predetermined fiber angles with respect to the laminate axes, is capable of radiating sound waves through flexural vibration of the plate when excited by the transducers. The area of the laminated composite radiating plate is divided into feasible and infeasible regions. A laminated composite plate with transducers mounted in the infeasible region radiates too low sound pressure level to be practical. On the contrary, sound pressure level above 80 dB can normally be achieved over a specific frequency range if the plate is excited by transducers mounted in the feasible region. The area of the feasible region is determined using the method revealed in the present invention. The peripheral edge of the laminated composite radiating plate is stiffened by strips of predetermined rigidities. Sound quality and radiation efficiency of the panel radiator over a desired acoustic frequency range are dependent on values of particular parameters of the radiator, including lamination arrangement of the laminated composite radiating plate, specific moduli of the composite laminae used for fabricating the radiating panel, rigidities of the edge strips, and locations of the transducers mounted in the feasible region on the laminated composite radiating plate. Proper selection of the values of the parameters can produce required achievable sound pressure level spectrum of the panel radiator for operation of the loudspeaker over a desired operative acoustic frequency range.

Another object of the invention is to provide a method for designing a laminated composite panel radiator which includes a laminated composite plate stiffened around its peripheral edge with strips of suitable rigidities and a number of transducers mounted on the surface of the laminated composite plate at predetermined locations in the feasible region on the radiating plate. Optimal values of particular parameters of the laminated composite panel radiator, including lamination arrangement of the laminated composite plate and specific moduli of the constituted composite lamina, the area of the feasible region on the laminated composite plate, rigidities of the edge strips, and locations of the transducers in the feasible region are selected in the design process to achieve the required sound pressure level spectrum of the panel radiator for operation of the loudspeaker over a desired acoustic frequency range.

The present invention may best be understood through the following descriptions with reference to the accompanying drawings, in which:

THEORETICAL BACKGROUND OF THE PROPOSED METHOD

Figure 1:
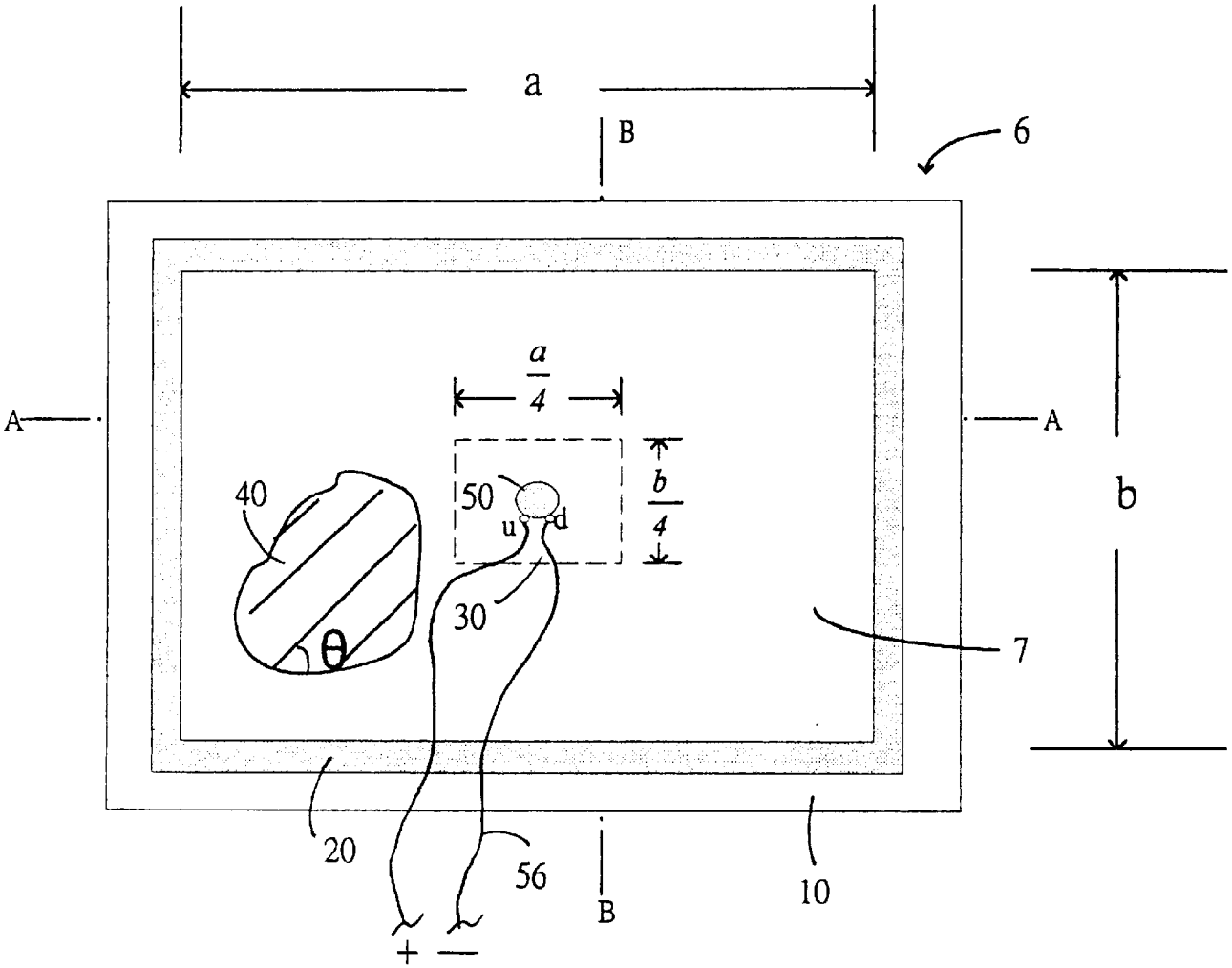
FIG. 1 is an illustration of a laminated composite panel-form loudspeaker with an electrodynamic type transducer mounted in the feasible region on the panel radiator.

A vibrating plate is a surface sound source which displaces air volume at the interface. For an infinitely extended or baffled plate under flexural vibration, the sound pressure radiated from the plate with area s can be evaluated using Rayleigh's first integral. The expression in integral form is $$p(r, t) = \frac{i\omega^2\rho_o}{2\pi} e^{i\omega t} \int_s \frac{D(r_s)e^{ikR}}{R} ds \tag{1}$$

where p(r, t) is sound pressure at a distance r from the origin on the surface of the plate, R is the distance between the observation point and the position of the differential surface element with distance $r_s$ away from the origin, $\rho_o$ is air density, t is time, ω is the plate vibrating frequency, D is plate deflection, $i=\sqrt{-1}$. It is noted that the relation between plate normal velocity $V_n$ and deflection D, i.e., $V_n$=wD, has been observed in Equation (1) In case the vibrating plate is unbaffled or of finite size, the sound pressure radiated from the plate can be evaluated using the finite element or boundary element methods. The sound pressure level at the point of observation is obtained from the equation $$L_p = 20 \log_{10} \frac{P_{\text{rms}}}{P_{ref}} \tag{2}$$

where $L_p$ is sound pressure level, $P_{rms}$ is the root-mean-square value of sound pressure at the point of observation, $P_{ref}$ is the reference pressure which is a constant. In view of Equation (1), for a specific point of observation the root-mean-square value of sound pressure depends on the vibration frequency and deflection of the plate which in fact can be determined in the modal analysis of the plate. The modal analysis of the plate, on the other hand, can be accomplished using the finite element method. The deflection of the plate is approximated as the sum of the modal deflections expressed in the following form $$D(r_s) = \sum_{i=l}^{n} A_i \Phi_i(r_s) \tag{3}$$

where n is the number of resonant modes under consideration, $A_i$ and $\Phi_i$ are the modal amplitude and mode shape of resonant mode i, respectively. In view of Equations (1)–(3), the sound pressure level is dependent on the modal parameters, including modal amplitudes and mode shapes, which on the other hand depend on the mass and stiffness of the plate as well as the locations of excitation on the plate. For a laminated composite plate with stiffened peripheral edge, parameters such as specific moduli of the constituted composite laminae, lamination arrangement of the plate and rigidities of the edge strips have important effects on the stiffness of the plate, which in turn affects the modal parameters of the plate. The locations of excitation on the radiating plate have direct effects on the magnitudes of the modal amplitudes in Equation(3). Thus it should avoid mounting the transducers on the modal node lines of the plate since the coincidence between excitation locations and modal node lines of a resonant mode will significantly diminish the sound pressure level radiate from the plate vibrating at the natural frequency associated with the resonant mode. As having been pointed out, for a simple radiating plate, the determination of the locations of excitation that can avoid coincidence with modal node lines and induce satisfactory sound radiation from the plate is a painful task. Nevertheless, the attachment of stiffeners to the peripheral edge of the simple plate can greatly simplify the process for excitation locations determination and alleviate the unfavorable effects caused by the coincidence between excitation locations and modal node lines of the plate. This advantage of using edge strips is due to the fact that a proper selection of rigidities of edge stiffeners for the radiating plate can slight shift the modal node lines of the plate away from the locations of excitation and thus improve the sound response of the plate. It is noted that the area of the radiating plate is divided into feasible and infeasible regions and also the transducers are mounted in the feasible region. Therefore, the locations of the transducers in the feasible region are determined via an iterative procedure wherein a series of analyses of sound pressure level spectra for cases with different edge strip rigidities and transducer locations are performed. Regarding the modal parameters, the shapes of resonant modes have important effects on the sound waves radiated from the plate. For a resonant mode with regions on the plate oscillating in opposite phase, the sound waves emitting from adjacent regions of opposite vibration phase tend to short circuit each other. In that case, sound pressure radiated from regions on the plate with uncanceled volume velocity depends on the deflected shapes of the resonant modes. For a simple radiating plate of symmetric shape, the interferences of sound waves of opposite phase for resonant modes with natural frequencies in the frequency range from, for instance, 50 Hz to 500 Hz are paramount and destructive as well. Again the attachment of stiffeners with predetermined rigidities to the peripheral edge of the simple plate can modify the shapes of the resonant modes so that interferences among the sound waves can be significantly reduced. On the other hand, modal amplitudes and natural frequencies have direct effects on sound pressure level in such a way that large modal amplitudes coupled with unsymmetrical mode shapes or the coincidences of frequencies of input excitation with natural frequencies tend to produce high sound pressure level.

In accordance with an aspect of the invention, the parameters such as specific moduli of the constituted composite laminae, lamination arrangement of the laminated composite radiating plate, rigidities of the plate edge strips and locations of transducers in the feasible region on the radiating plate are selected via an iterative approach to make the sound pressure level more uniformly distributed over a desired frequency range. The specific moduli considered in the design of laminated composite panel radiator are defined as $E_1/\rho$ and $E_2/\rho$ in which $E_1$, $E_2$ are Young's moduli in fiber and matrix directions, respectively and $\rho$ is material density. The values of specific moduli have important effects on the levels of sound pressure radiated from a plate vibrating at different frequencies. A panel radiator made of composite materials with relatively small specific moduli may only be able to radiate sound pressure efficiently in lower frequency range. On the other hand, the panel radiator can radiate relatively high level of sound pressure in both low and high frequency ranges if large specific moduli are used. Therefore, specific moduli of composite materials must be properly selected to achieve a desired sound pressure level spectrum over a predetermined frequency range. In the present invention of a laminated composite panel-form loudspeaker with an operative acoustic frequency range from 50 Hz to 20 KHz, appropriate specific moduli of composite materials determined in a series of acoustic analyses are given as following $$80 < \frac{E_1}{\rho} < 180 \ (\mathrm{g/cm^3}) \qquad (4)$$

$$3 < \frac{E_2}{\rho} < 10 \ (\mathrm{g/cm^3})$$

The radiating panel is of rectangular shape with size a×b×h where a is length, b is width, h is thickness and b is in the range from ½ to a. The lamination arrangement to be determined includes number of plies and fiber angles of the plies that constitute the radiating panel. Ply fiber angles have important effects on the stiffness of the plate which in turn affects the modal parameters including natural frequencies, modal amplitudes and deflected shapes of resonant modes of the plate. The best lamination arrangements for fabricating the radiating panel are cross-ply lamination such as $[0°/90°/0°/\ldots]_s$ or angle-ply lamination such as $[\theta°/-\theta°/\theta°/\ldots]_s$ where the subscript "s" denotes symmetric lamination and θ° is between 0 degree and 90 degree. Number of laminae, on the other hand, affects the natural frequency distribution and magnitudes of modal amplitudes of the radiating plate. The selection of number of laminae depends on the size of the panel radiator. For a panel radiator with length, a, less than 30 cm, the number of laminae is chosen as 3 or less; for a greater than 30 cm and less than 50 cm, the number of laminae is 4; for a greater than 50 cm, the number of laminae is 5 or more.

The peripheral edge of the present radiating panel is reinforced with thin and long edge strips. The edge strips, which are bonded to the peripheral edges of the panel radiator, may have rectangular cross sections of different rigidities. For a rectangular panel radiator, there are at most four edge strips bonded to the four edges of the panel. The rigidity of each strip depends on the cross-sectional area of the strip and Young's modulus of the constituted material. The rigidities of the peripheral edge strips of the panel radiator can affect the stiffness distribution of the radiating panel, which in turn affects the modal parameters including natural frequencies, modal amplitudes and mode shapes of the panel radiator. Proper selection of edge strip rigidities can alter the deflected shapes of resonant modes and thus reduce the interference among the sound waves radiated from regions of opposite vibration phase. The reduction of interference of sound waves can increase the sound pressure level and produce a more uniformly distributed sound pressure level spectrum over a desired acoustic frequency range. Another advantage of using edge strips is that they can damp out the standing waves at the peripheral edge of the radiating panel so that high frequency noise can be suppressed.

To facilitate and expedite the parameters identification process, the determination of the rigidity of each edge strip is subject to the constraints that the thickness of each strip is less than three times the thickness of the panel radiator, the width of each strip is less than one tenth of the width of the panel radiator, and the Young's modulus of each strip is less than or equal to the Young's modulus $E_1$ of the composite laminae used for fabricating the panel radiator. In the design process, the rigidities of the edge strips are chosen in such a way that the sound pressure level is maximized and a more uniform distribution of sound pressure level spectrum over a desired frequency range is attained. The vanish of the rigidity of a strip indicates that the associated edge of the panel radiator is unstiffened.

The transducers used to excite flexural vibration of the radiating panel can be electrodynamic type or piezoelectric type transducers. The locations for mounting the transducers on the panel radiator are determined to maximize the sound pressure level and make the distribution of sound pressure level spectrum more uniform over a desired frequency range. The panel radiator is divided into feasible and infeasible regions which are determined in a sound pressure level analysis of the radiating panel based on the aforementioned method. The transducers must be located in the feasible region on the panel radiator in order to achieve satisfactory sound pressure level for the loudspeaker. Without loss of accuracy, the size and location of the feasible region can be determined in a sound pressure level analysis of the panel radiator without peripheral edge stiffeners. The feasible region is thus selected as a rectangular area with length a/4 and width b/4 and the center of the feasible region coincides with that of the panel radiator.

The design of a highly efficient laminated composite panel-form loudspeaker involves the determination of parameters including specific moduli of composite material laminae, lamination arrangement of panel radiator, rigidities of edge strips and locations of transducers. In general, the parameters determination process can be achieved via an iterative approach. Since optimization methods have been widely used to solve engineering problems, the utilization of an appropriate optimization algorithm can facilitate and expedite the process of parameters determination. The process of parameters determination can be further simplified if the specific moduli of composite material and the lamination arrangement of the radiating panel are chosen in advance. In fact, the preselection of specific moduli and lamination arrangement of the laminated composite radiating plate has little effect on the final design of the panel-form loudspeaker. Once the specific moduli of composite material and plate lamination arrangement have been given, the rigidities of edge strips and locations of transducers in the feasible region can be easily determined in a series of sound pressure level spectrum analyses as described in the proposed method given in the present invention.

DETAILED DESCRIPTION OF THE PREFERRED EMBODIMENTS

Preferred embodiments of the present invention will be described hereunder with reference to the accompanying drawings.

Referring to FIG. 1 of the drawings, a panel-form loudspeaker (6) consists of a panel-form radiator (7) peripherally supported by a suspension system (20) which is in turn mounted on a rectangular frame (10). The suspension system (20), which is adhesively bonded to the peripheral edges of the rectangular frame (10) and the panel-form radiator (7), is used to damp out the standing waves of short wavelength at the peripheral edge of the panel radiator (7). The suspension may be in the form of foam type rubber strips, a continuous plastic spider with long, thin legs or a soft plastic-impregnated corrugated cloth. The panel-form radiator (7) consists of a laminated composite radiating plate (40) stiffened around its peripheral edge with long and thin strips (60) of predetermined rigidities, which will be described later with reference to FIG. 3, and a transducer (50) mounted in the feasible region (30) on the composite radiating plate. The laminated composite radiating plate (40) is a stack of predetermined number of fiber reinforced polymeric composite laminae with predetermined fiber angles θ. The lamination arrangement, which includes number of piles and ply fiber angles, of the laminated composite radiating plate will be described later with reference to FIG. 3. The transducer (50) driven by a signal amplifier via a pair of lead conductors (56) serves to excite flexural vibration of the laminated composite plate and thus cause the plate to radiate sound pressure. The feasible region (30) for accommodating the transducer is of size $$\frac{a}{4}\times\frac{b}{4},$$

having its center coincide with that of the laminated composite radiating plate. The location of the transducer in the feasible region and the lamination arrangement of the laminated composite radiating plate can be preselected in advance so long as the rigidities of the edge stiffeners are determined using the proposed method given in the present invention. It worths nothing that the mounting of the transducer outside the feasible region will significantly reduce the level of sound pressure radiated from the laminated composite radiating plate and thus render the radiating plate impractical for being used as an acoustic radiator. The plate length a is better to be less than or equal to 40 cm if only one transducer is mounted on the radiating plate.

Figure 2A:
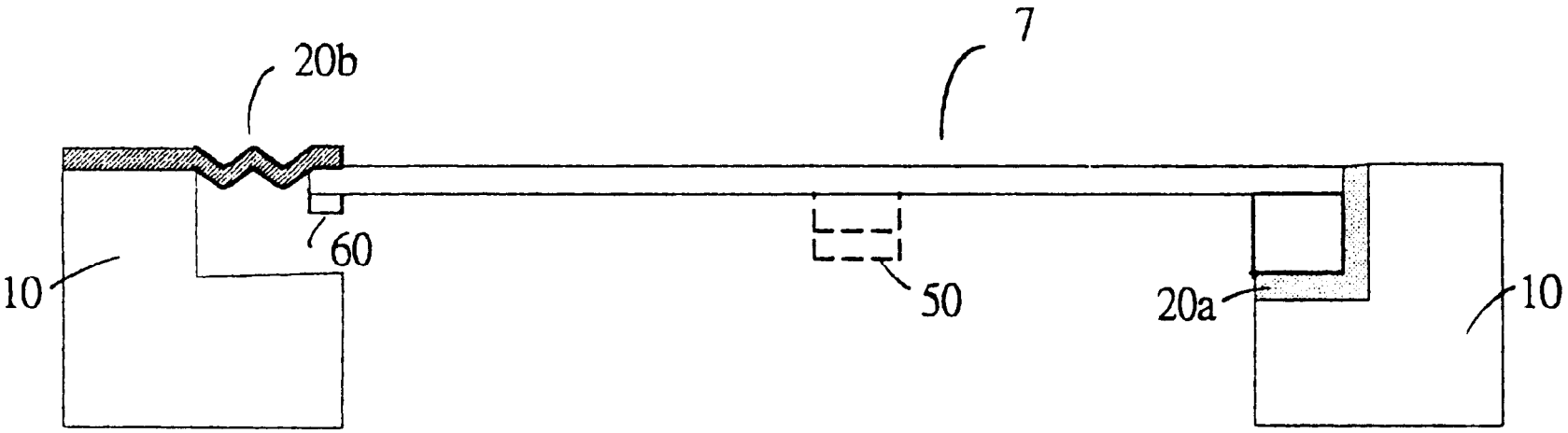
FIG. 2*a* is a typical section of FIG. 1 showing a foam rubber type suspension and a soft plastic-impregnated corrugated cloth type suspension on the right and left edges of the panel-form radiator, respectively.
Figure 2B:
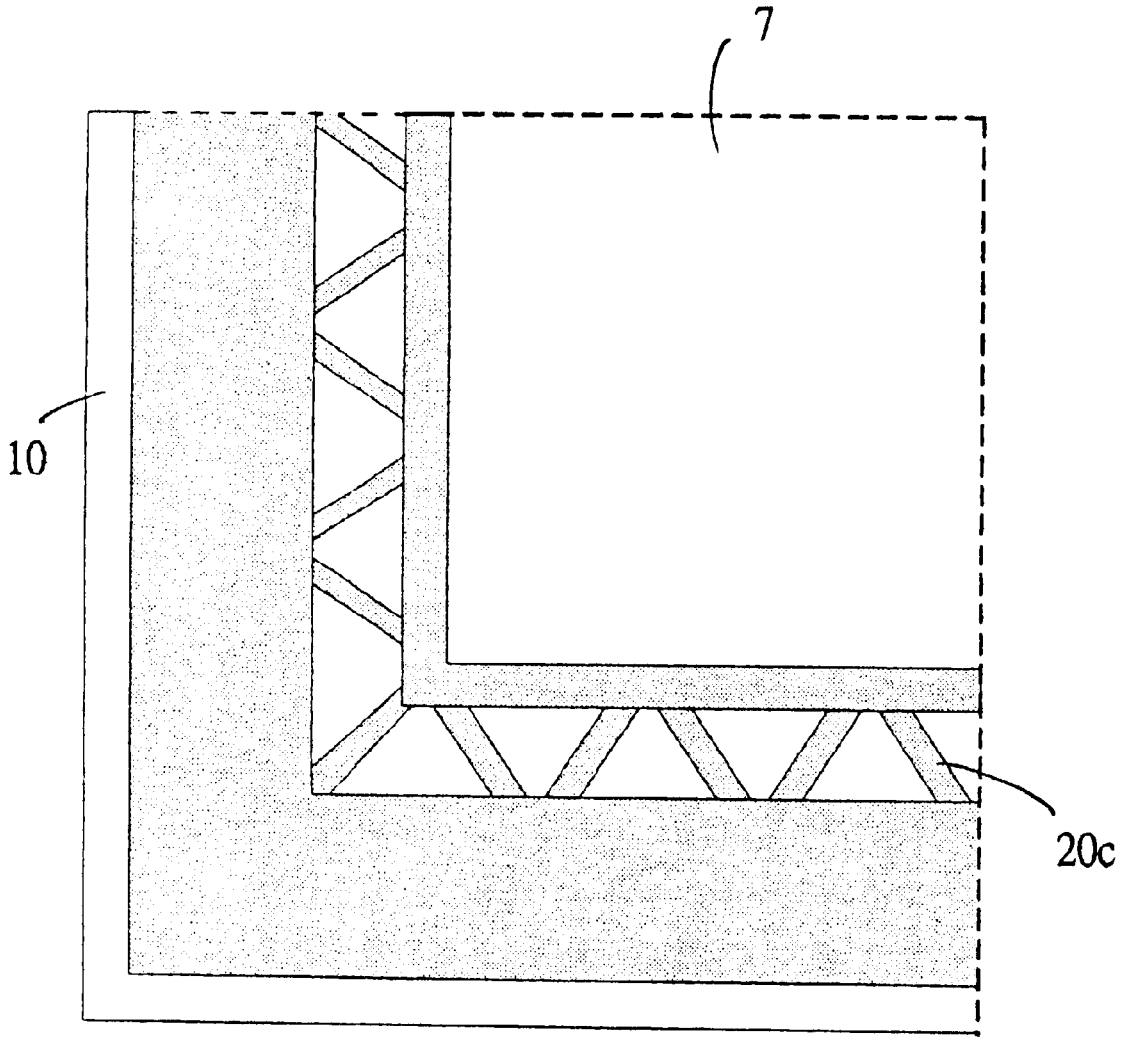
FIG. 2*b* is a partial front view of FIG. 1 showing a plastic spider type suspension in supporting the panel-form radiator.

FIGS. 2*a* and 2*b* are illustrations of different types of flexible suspension systems (20). FIG. 2*a* is a cross-sectional view of the loudspeaker of FIG. 1, which illustrates the applications of foam rubber type (20*a*) and soft plastic-impregnated corrugated cloth type (20*b*) suspensions in supporting the panel-form radiator (7). Both suspensions are adhesively bonded to the peripheral edges of the rectangular frame (10) and the panel-form radiator (7). FIG. 2*b* is an enlarged partial front view of the loudspeaker (6) of FIG. 1, which shows the application of the plastic spider type suspension (20*c*) in supporting the panel-form radiator (7). The two edges of the plastic spider suspension are adhesively bonded respectively to the peripheral edges of the rectangular frame (10) and the panel-form radiator (7).

Figure 3A:
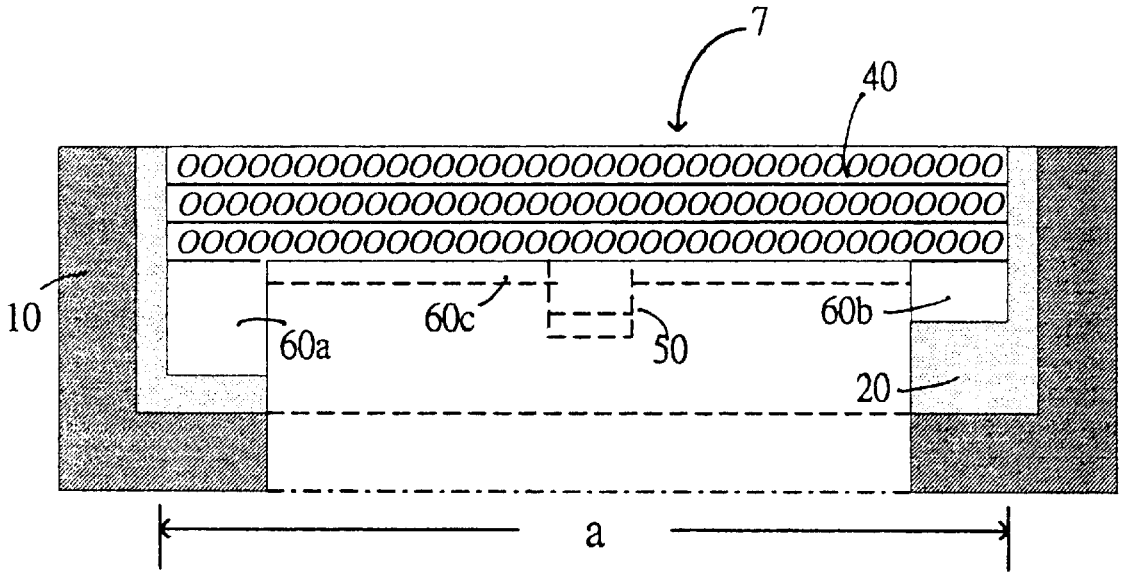
FIG. 3*a* is a section of FIG. 1 on the line A—A.
Figure 3B:
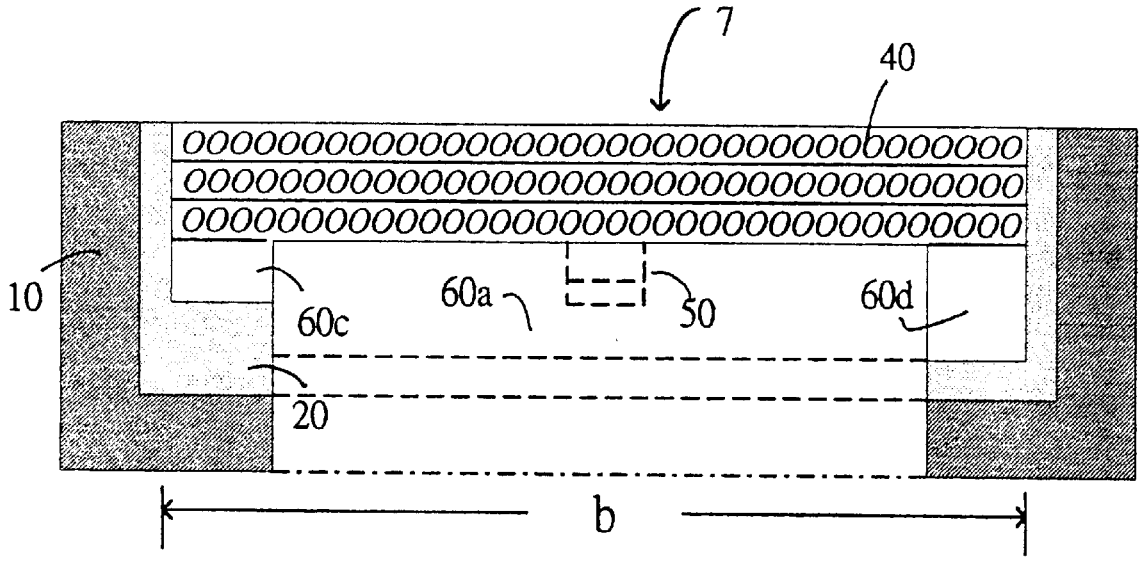
FIG. 3*b* is another section of FIG. 1 on the line B—B.

FIGS. 3*a* and 3*b* are typical cross-sectional views across the length and width, respectively, of the loudspeaker (6) of FIG. 1 showing the rectangular frame (10), the suspension (20), and the stiffened laminated composite radiating plate (7). In FIG. 3*a*, which is a view at section A—A, a three-layered composite plate (40) stiffened by edge strips (60) of different rigidities is used as an example to illustrate the structure of the radiator (7). The composite material laminae used for fabricating the laminated composite radiating panel have specific moduli of magnitudes given in Equation (4). The thickness of each lamina is in the range from 0.1 mm to 0.2 mm. Although the laminated composite plate shown in FIG. 3*a* only comprises three laminae, the actual number of laminae used for fabricating the plate in fact depends on the size of the panel-form radiator (7) and the desired operative acoustic frequency range. As a rule of thumb, for a panel radiator with different values of length a, the number of laminae N is chosen as:

$$\begin{aligned} &N\leqq 3 \text{ for } a\leqq 30 \text{ cm},\\ &N=4 \text{ for } 30 \text{ cm}<a\leqq 50 \text{ cm},\\ &\text{or } N\geqq 5 \text{ for } a>5 \text{ cm} \end{aligned} \tag{5}$$

It is suggested that laminated composite sandwich plates with foam core be used as radiating panels if a is greater than 50 cm. The layup of the laminated composite plate is either cross-ply such as $[0°/90°/0°/\ldots]_s$ or angle-ply such as $[0°/-0°/\theta°/\ldots]_s$ with $0°<\theta°<90°$. The edge strips (60) used for adjusting the resonant mode shapes of and tuning the level of sound pressure radiated from the radiating panel are of different rigidities. Again as a rule of thumb, the thicknesses of the edge strips are less than three times the thickness of the radiating panel, the widths of the edge strips are less than one tenth of the width of the radiating panel, and the Young's modulus of the edge strips is less than or equal to the Young's modulus $E_1$ of the composite lamina. FIG. 3*b* is another view at section B—B of the loudspeaker of FIG. 1 showing the laminated composite radiating panel stiffened by different edge strips.

Figure 4A:
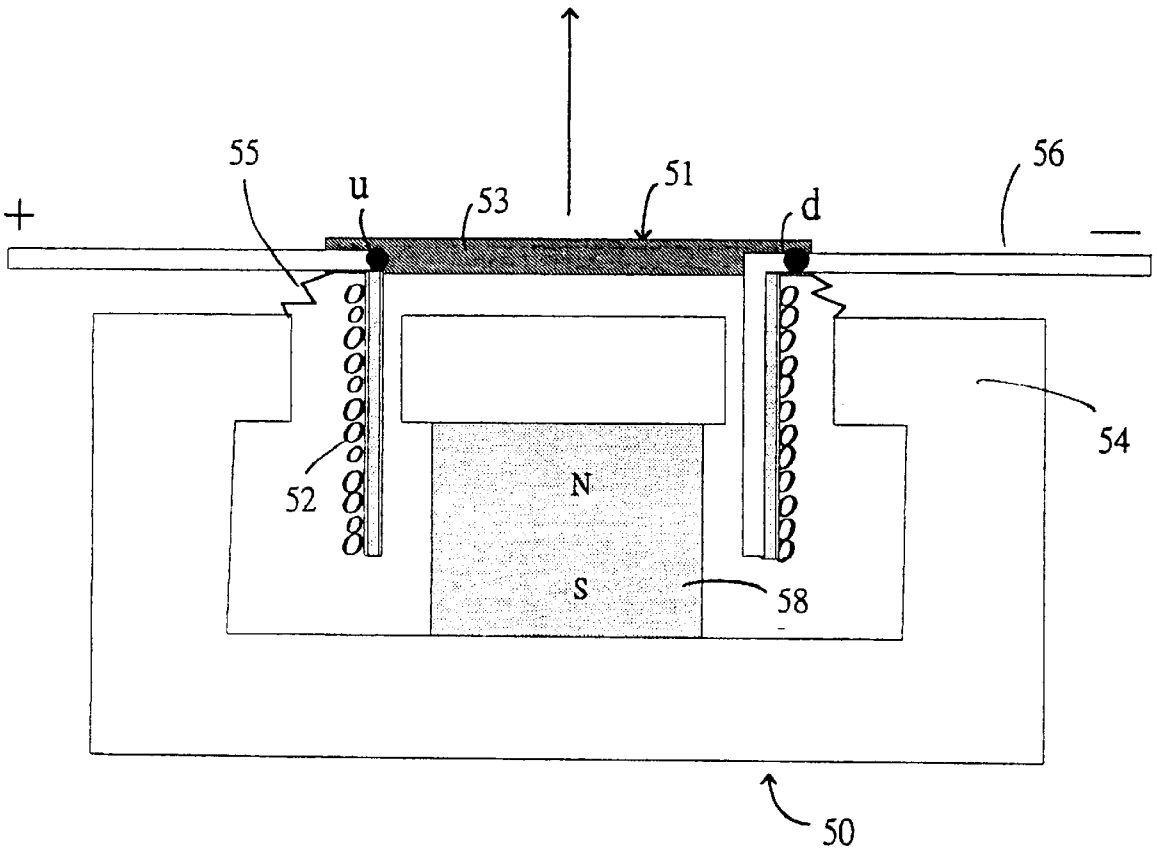
FIG. 4*a* is an electrodynamic transducer with electric current flowing from top to bottom of the moving coil which yields an upward axial movement.
Figure 4B:
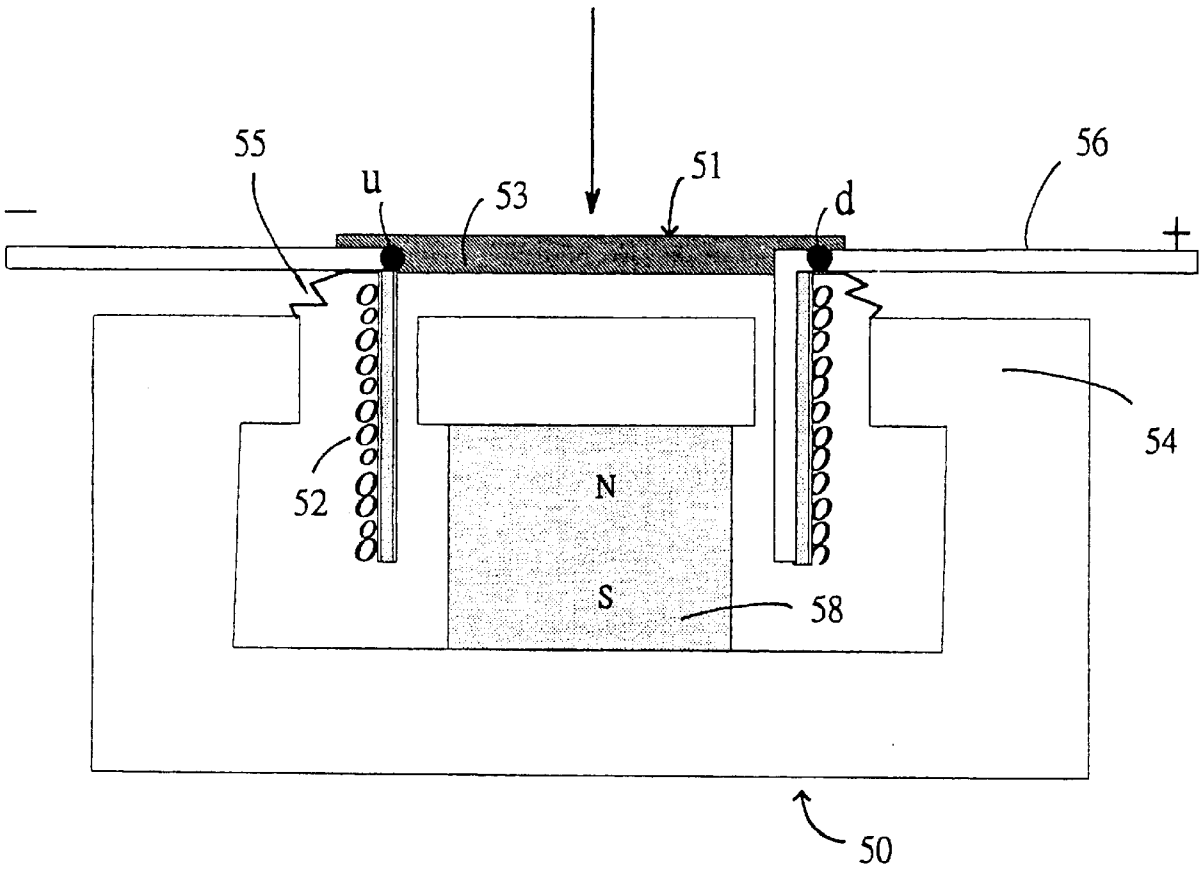
FIG. 4*b* is the electrodynamic transducer of FIG. 4*a* with reversed flow of electric current in the moving coil which yields a downward axial movement.

FIGS. 4*a* and 4*b* show different current flow patterns in an electrodynamic transducer (50) and the associated axial movements of the transducer. The electrodynamic transducer (50) comprises a magnet (58) enclosed by a pair of poles (54) and a voice coil assembly (51) concentrically circulating around the magnet (58). The voice coil assembly (51) is actuated to produce an axial movement relative to the magnet when current flows through the coil (52) from one lead conductor (56) to the other. The cover (53) of the voice coil assembly is a rigid plate supported by a resilient support (55) around the peripheral edge of the cover. The cover (53) which is adhesively bonded to the surface of the radiating panel (7) serves to launch flexural vibration of the radiating panel via the axial movement of the voice coil assembly. In FIG. 4*a*, the electrical current flows into the voice coil of the electrodynamic transducer from the left lead conductor through joint u and comes out of the voice coil from the right lead conductor through joint d. Such pattern of current flow in the transducer generates an upward axial movement of the voice coil assembly. On the contrary, the flow direction of electrical current in the voice coil of the transducer is reversed in FIG. 4*b* and thus a downward axial movement of the voice coil assembly is induced by the electrical current flow.

Figure 5:
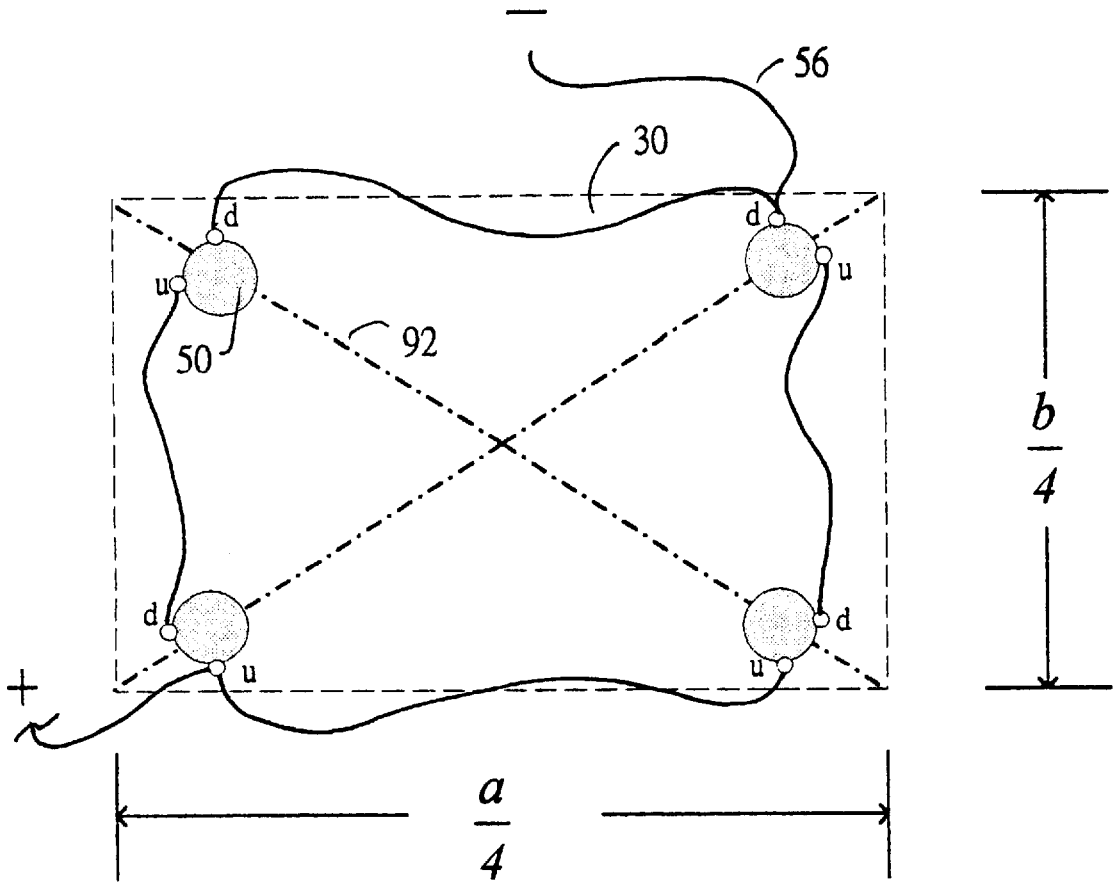
FIG. 5 is an illustration of the mounting pattern of four electrodynamic transducers in the feasible region on the radiating plate for the panel-form loudspeaker in accordance with the present invention.

FIG. 5 shows one of the possible patterns for mounting four transducers (50) in the feasible region (30) on the radiating panel (7). The four transducers are situated on the diagonal lines (92) of the rectangular feasible region. The distance between each transducer and the center of the feasible region is determined using the proposed method given in the present invention. The flow patterns of electrical current in all the transducers are the same and thus the axial movements of all the transducers are in phase. The resistance of the circuit of the transducers, $R_s$, can be expressed in terms of the resistances of the transducers. If all the transducers have the same resistance R, using Ohm's law it can be shown that the resistance of the circuit of FIG. 5 is the same as that of each transducer, i.e., $R_s$=R. The plate length a is better to be greater than 40 cm and less than or equal to 100 cm if four transducers are mounted on the radiating plate.

Figure 6:
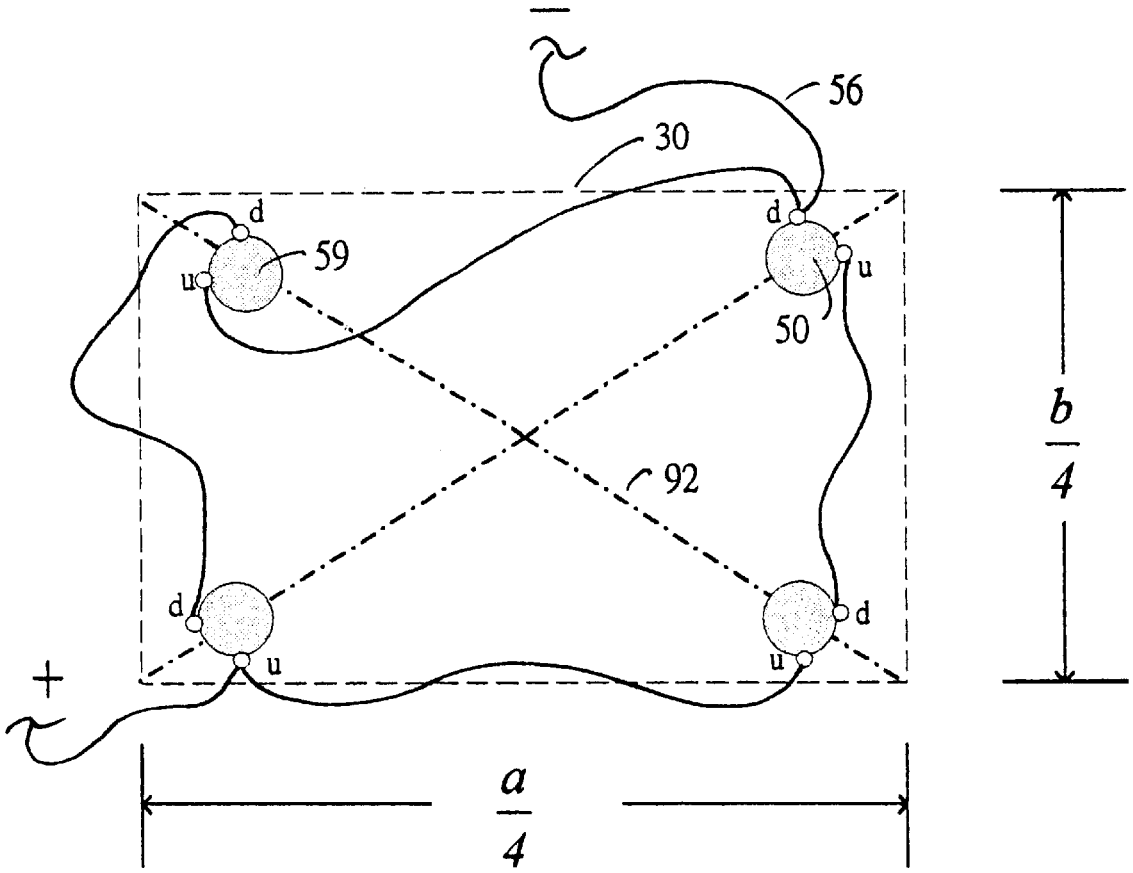
FIG. 6 is an illustration of another mounting pattern of four electrodynamic transducers in the feasible region on the radiating plate for the panel-form loudspeaker in accordance with the present invention.

FIG. 6 shows another possible pattern for mounting four transducers (50) in the feasible region (30) on the radiating panel (7). Among the four transducers, three of them have the same electrical current flow pattern of the transducer in FIG. 4*a* while one transducer (59) has the reversed flow direction, i.e., the flow pattern of the transducer in FIG. 4*b*. The four transducers are situated on the diagonal lines of the feasible region. The distance between each transducer and the center of the feasible region is determined using the proposed method given in the present invention. The transducer (59) that has different current flow pattern from the others (50) excites the radiating panel with opposite phase motion and thus works as an active damper to suppress undesirable vibrations of the radiating panel so that more uniform level of sound pressure in a specific frequency range can be obtained.

Figure 7:
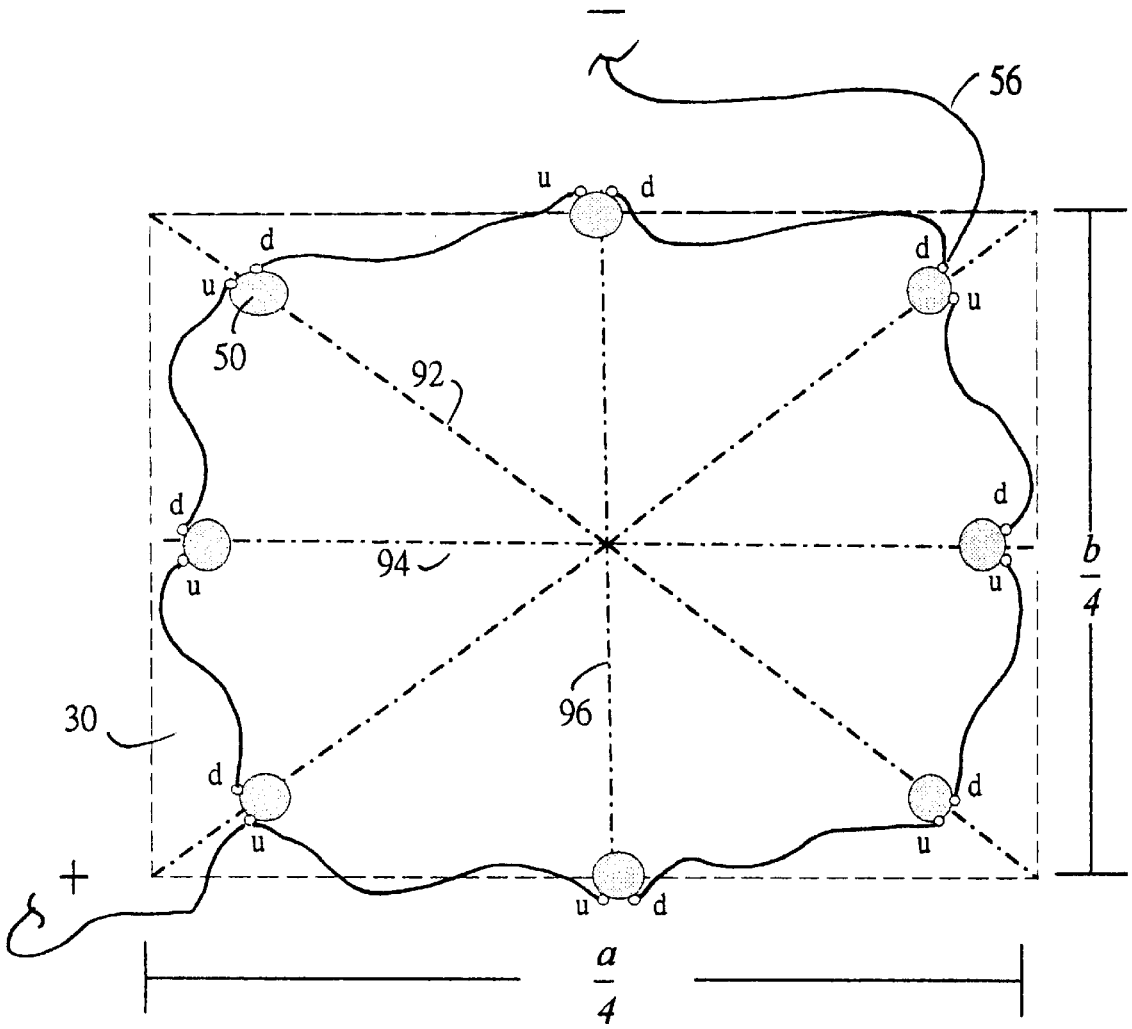
FIG. 7 is an illustration of the mounting pattern of eight electrodynamic transducers in the feasible region on the radiating plate for the panel-form loudspeaker in accordance with the present invention.

FIG. 7 shows the mounting pattern of a set of eight transducers (50) which is used to excite the flexural vibration of the radiating panel (7). The transducers are situated on specific lines including two diagonal (92), one horizontal (94), and one vertical (96) lines in the feasible region (30). All the lines pass through the center of the feasible region. The distances between the transducers and the center of the feasible region are determined using the proposed method given in the present invention. It is preferable that the transducers are situated on the circumference of a circle in the feasible region with radius greater than b/6 and less than or equal to b/4. The centers of the circle and the feasible region are coincident. The resistance of the circuit of the transducers is 2R where R is the resistance of each transducer. The plate length a is better to be greater than 100 cm and less than or equal to 200 cm if eight transducers are mounted on the radiating plate.

Figure 8:
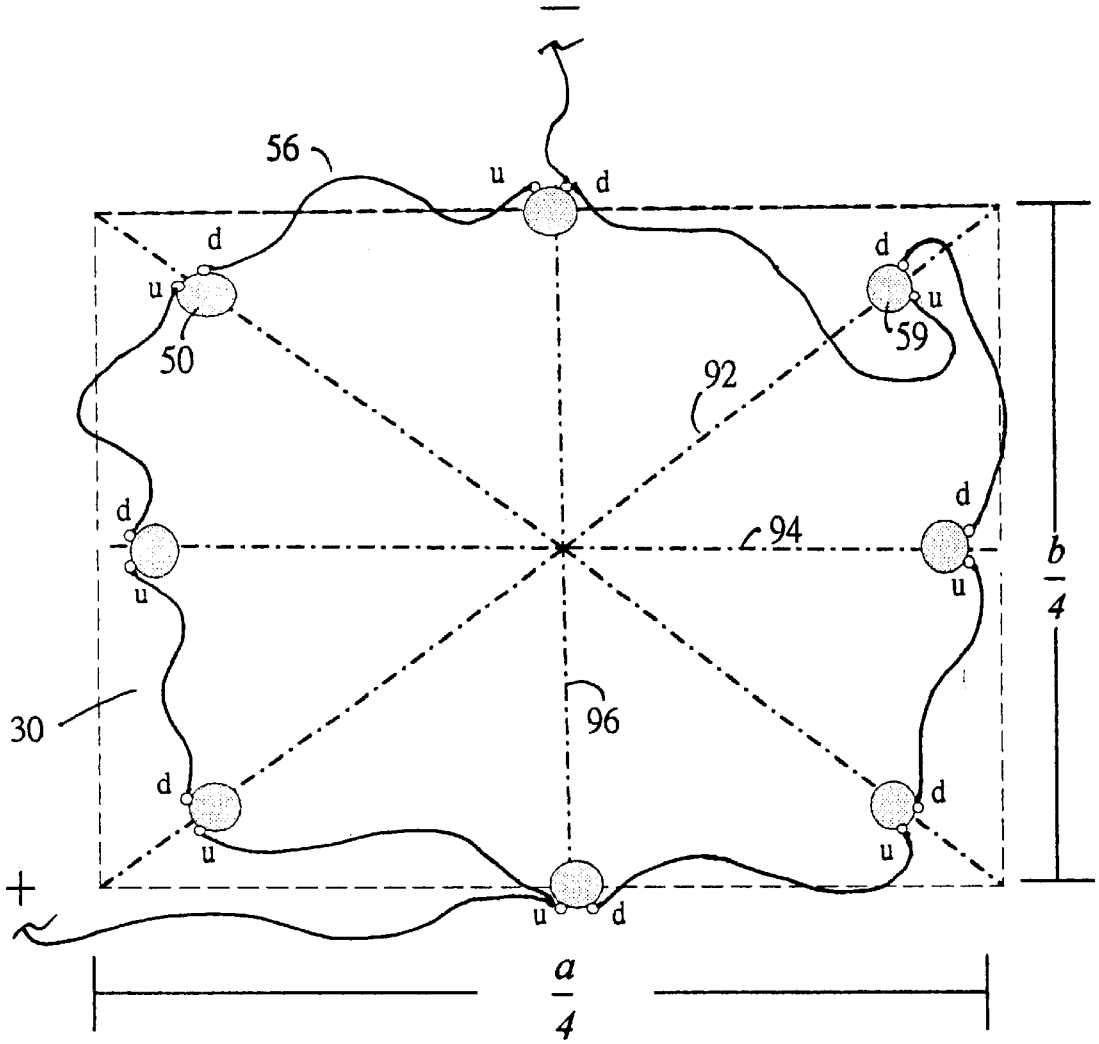
FIG. 8 is an illustration of another mounting pattern of eight electrodynamic transducers in the feasible region on the radiating plate for the panel-form loudspeaker in accordance with the present invention.

FIG. 8 shows another possible mounting pattern of a set of eight transducers (50) which are used to excite the flexural vibration of the radiating panel (7). Among the eight transducers, seven of them (50) have same direction of electrical current flow in the voice coils of the electrodynamic transducers while one transducer (59) has the reversed direction of current flow in the voice coil of the transducer. The transducer (59) that has reversed flow direction will generate an axial movement with phase opposite to those of the other transducers. The transducers are situated on the specific lines which include two diagonal (92), one horizontal (94), and one vertical (96) lines in the feasible region. All the lines pass through the center of the feasible region. The distances from the center of the feasible region to the transducers are determined using the proposed method given in the present invention. One preferable pattern for mounting the transducers is that except the transducer (59) with reversed flow direction, all the transducers with same flow direction are situated on the circumference of a circle with radius larger than b/6 and less than or equal to b/4. The distance between the transducer (59) with reversed flow direction and the center of the feasible region is then determined to improve the performance of the radiating panel for a given set of locations for the transducers with same flow direction. The transducer of reversed flow direction serves as an active damper to suppress undesirable vibration of the radiating panel so that more uniform spread of sound pressure level spectrum over a desired frequency range can be obtained. The resistance of the circuit of the transducers is twice the resistance of each transducer. Other mounting patterns with two transducers having reversed current flow direction are self-evident and the locations of the eight transducers can be determined using the proposed method given in the present invention.

Figure 9:
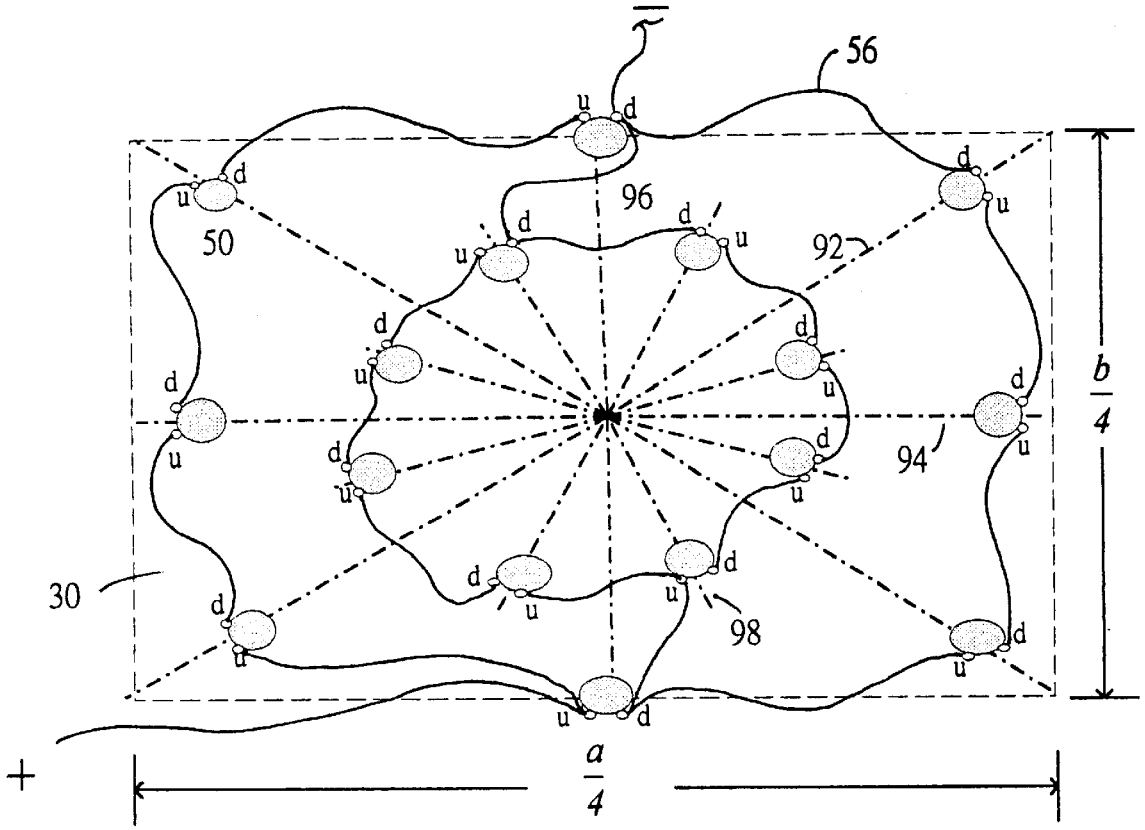
FIG. 9 is an illustration of the mounting pattern of sixteen electrodynamic transducers in the feasible region on the radiating plate for the panel-form loudspeaker in accordance with the present invention.

FIG. 9 shows the mounting pattern of a set of sixteen transducers (50) which are used to excite the flexural vibration of the radiating panel (7). The transducers are situated on specific lines in the feasible region (30). The lines which pass through the center of the feasible region are divided into two groups. The first group of lines includes a vertical (96), a horizontal (94), and two diagonal lines (92). The second group of lines includes lines (98) bisecting the angle between any two neighboring lines in the first group. The distances between the transducers and the center of the feasible region are determined using the proposed method given in the present invention. One preferable pattern for mounting the transducers is that the transducers are situated on the circumferences of two concentric circles of different radii. The first eight transducers located on the lines in the first group are situated on the circumference of the outer circle of which the center coincides with that of the feasible region and the radius of the outer circle is b/4. The other eight transducers located on the lines in the second group are situated on the circumference of the inner circle of which the radius is b/8. The resistance of the circuit of the transducers is the same as that of each individual transducer. The plate length a must be greater than 100 cm if sixteen transducers are mounted on the radiating plate.

Figure 10:
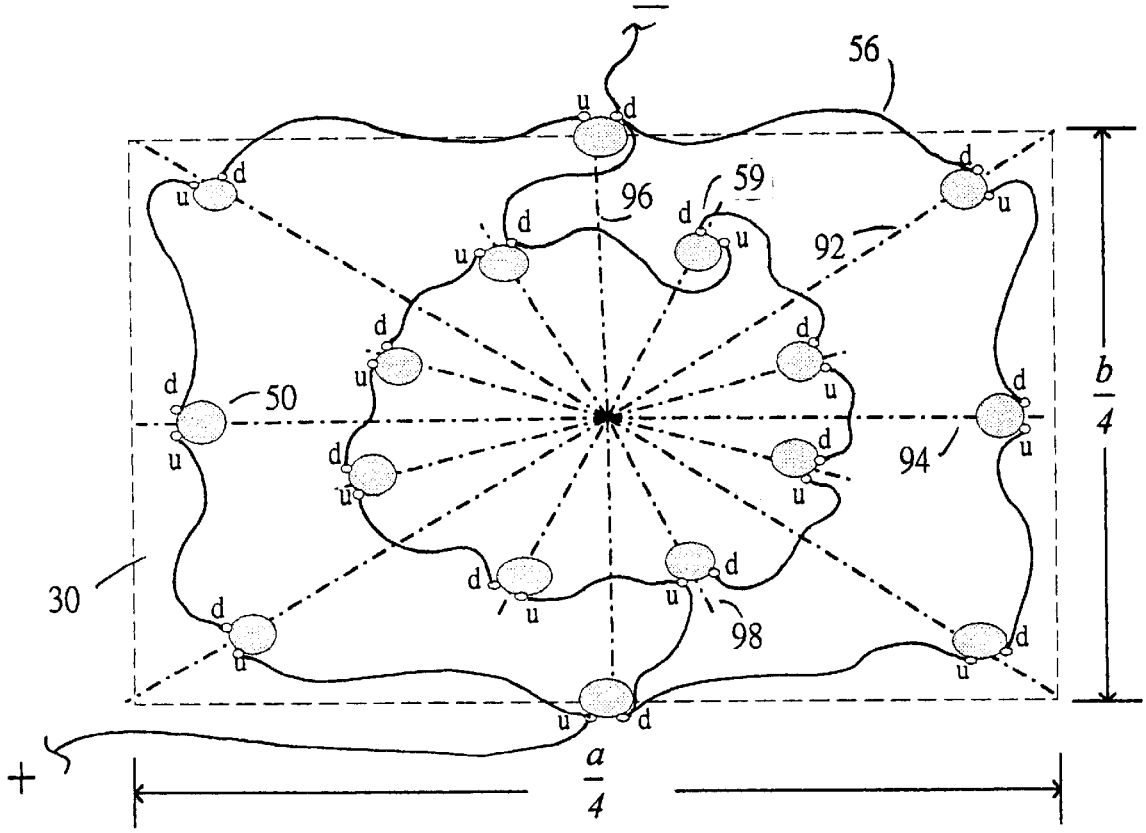
FIG. 10 is an illustration of another mounting pattern of sixteen electrodynamic transducers in the feasible region on the radiating plate for the panel-form loudspeaker in accordance with the present invention.

FIG. 10 shows another possible pattern for mounting a set of sixteen transducers in the feasible region (30) to excite the flexural vibration of the radiating panel (7). Among the sixteen transducers, fifteen of them have same flow direction and one has the reversed flow direction. The transducer (59) with reversed flow direction is used as an active damper generating movement with phase opposite from those of the other transducers to suppress unwanted vibrations of the radiating panel (7) so that more uniform distribution of sound pressure level spectrum over a desired frequency range can be obtained. All the transducers are mounted on lines passing through the center of the feasible region (30). The lines on which the transducers are mounted are divided into two groups. Among the transducers, eight of them with same flow direction of electrical current are located on the lines in the first group of lines which contains one horizontal (94), one vertical (96), and two diagonal lines (92). The other eight transducers including the one with reversed flow direction are located on the lines in the second group which contains lines (98) bisecting the angle formed by any two neighboring lines in the first group. The distances between the transducers and the center of the feasible region are determined using the proposed method given in the present invention. One preferable pattern is that the transducers associated with the two different groups of lines are situated on the circumferences of two different concentric circles of which the centers coincide with that of the feasible region. The transducers associated with the first group of lines are situated on the circumference of the outer circle with radius equal to b/4. Except the transducer (59) with reversed current flow direction, all the transducers associated with the second group of lines are situated on the inner circle with radius equal to b/8. The actual distance between the center of the feasible and the transducer (59) with reversed flow direction is determined using the proposed method given in the present invention. The resistance of the circuit of the sixteen transducers is the same as that of each individual transducer. Other mounting patterns for cases with two or more transducers with reversed flow direction of electric current are self-evident and the locations of the sixteen transducers in the feasible region can be determined using the proposed method given in the present invention.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

We claim:

1. A method of making a panel-form loudspeaker including a rectangular laminated composite plate with length a and width b driven by a preselected number of transducers to produce asymmetric flexural vibrational mode shapes of said plate, the width b being shorter than the length a and longer than ¼ a, said method including steps of:

(a) determining a feasible region on the laminated composite plate peripherally stiffened by edge strips of preselected rigidities to accommodate a preselected number of transducers for launching flexural vibration of said plate, said feasible region being located in the central portion of said plate which when driven by said transducers at different locations in said feasible region produces maximum average sound pressure levels of same value over a specific frequency range;

(b) analyzing a sound pressure level spectrum over said frequency range generated by said laminated composite plate peripherally stiffened by edge strips, said sound pressure level spectrum varying according to values of parameters of said panel-form loudspeaker including ratio of elastic modulus in fiber direction to mass density and ratio of elastic modulus in direction transverse to the fiber direction to mass density of the composite material laminae constituting said laminated composite plate, lamination arrangement of said composite material laminae, locations of said transducers in said feasible region on said plate, and the rigidities of said edge strips, the analysis of said sound pressure level spectrum comprising a procedure of minimizing the variation of the sound pressure level distributed over said frequency range;

(c) selecting values of said parameters resulting in achieving a desired sound pressure level spectrum with minimum variation of sound pressure level distributed over said frequency range;

(d) making said laminated composite plate of said panel-form loudspeaker with said selected values of said parameters.

2. The method of claim 1 wherein said feasible region on said laminated composite plate for accommodating said preselected number of transducers is determined in a sound pressure level analysis, which involves evaluating spectra of sound pressure level over said specific frequency range for said laminated composite plate excited by one transducer mounted at different locations on said plate and determining the dimensions of said feasible region enclosing the driving points of said transducer for producing the maximum average sound pressure levels over said frequency range, and selected to cover a rectangular area with length ¾ and width b/4, said rectangular area's centroid being coincident with that of said plate and the sides with length ¾ of said rectangular area being in parallel to the sides with length a of said plate.

3. The method of claim 1 wherein the number of said transducers mounted in said rectangular region varies according to the size of said plate and is selected to be 1 for said length of said plate less than or equal to 400 mm, 4 for said length greater than 400 mm and less than or equal to 100 0mm, 8 for said length greater than 1000 mm and less than or equal to 2000 mm, and 16 for said length greater than 2000 mm.

4. The method according to claim 1 wherein said composite laminae constituting said laminated composite plate are made of polymeric resin reinforced by fibers in one direction of which the elastic modulus in Gpa in fiber direction is larger than the elastic modulus in direction transverse to the fiber direction, said laminae being selected to have the ratio of elastic modulus in fiber direction to mass density in $g/cm^3$ greater than 80 and less than 180 Gpa/($g/cm^3$) and the ratio of elastic modulus in direction transverse to the fiber direction to mass density greater than 3 and less than 10 Gpa/($g/cm^3$).

5. The method according to claim 1 wherein said lamination arrangement having a symmetric layup of said fiber-reinforced composite laminae for which the middle plane of the laminated composite plate is the plane of symmetry is selected to be one of symmetric cross-ply lamination in which each lamina having fibers parallel to the sides with length a of said plate is adjacent to at least one lamina having fibers perpendicular to the sides with length a of said plate and symmetric angle-ply lamination in which each lamina having fibers rotated a specific angle counter-clockwisely from the sides with length a of said plate is adjacent to at least one lamina having said specific angle of opposite sign between the fibers and the sides of length a of said plate, said specific angle being selected to be greater than 0 degree and less than 90 degrees, and contain 3 laminae or less for said plate with length a less than or equal to 300 mm, 4 laminae for said length a greater than 300 mm and less than 500 mm, and 5 laminae or more for said length a greater than or equal to 500 mm.

6. A panel-form loudspeaker for producing sound in response to varying audio signals, comprising:

(a) a rectangular laminated composite plate with length a and width b stiffened peripherally by edge strips, said width b being less than said length a and greater than a/4;

(b) at least one transducer mounted on the surface of said laminated composite plate to generate flexural vibration of said plate;

(c) a rectangular feasible region with length a/4 and width b/4 located on said plate of which the sides with length a are in parallel to the sides with length a/4 of said rectangular feasible region to accommodate said transducer, said rectangular feasible region being determined in a sound pressure level analysis which involves evaluating spectra of sound pressure level over a specific frequency range for said laminated composite plate excited by one transducer mounted at different locations on said plate and determining the dimensions of said rectangular feasible region enclosing the driving points on said plate driven by said transducer for producing the maximum average sound pressure levels; and (d) four edge strips coupled to the periphery of said vibrating plate.

7. The panel-form loudspeaker of claim 6 wherein said laminated composite plate comprises a preselected number of orthotropic composite laminae made of fiber-reinforced epoxy resin, the fibers used in said fiber-reinforced epoxy resin being one of carbon fibers, glass fibers, and boron fibers, each of said composite laminae being of thickness from 0.1 to 0.2 mm and having ratio of elastic modulus in Gpa in fiber direction to mass density in $g/cm^3$ greater than 80 and less than 180 $Gpa/(g/cm^3)$ and ratio of elastic modulus in direction transverse to the fiber direction to mass density greater than 3 and less than 10 $Gpa/(g/cm^3)$.

8. The panel-form loudspeaker of claim 6 wherein said laminated composite plate has a symmetric layup of a preselected number of fiber-reinforced composite laminae for which the middle plane of said laminated composite plate is the plane of symmetry, said symmetric layup being selected to be one of symmetric cross-ply layup in which each lamina having fibers parallel to the sides with length a of said plate is adjacent to at least one lamina having fibers perpendicular to the sides with length a of said plate and symmetric angle-ply layup in which each lamina having fibers rotated a specific angle counter-clockwisely from the sides with length a of said plate is adjacent to at least one lamina having said specific angle of opposite sign between the fibers and the sides of length a of said plate, said specific angle being selected to be greater than 0 degree and less than 90 degrees, and said preselected number of composite laminae being selected to be 3 or less for said plate with length a less than or equal to 300 mm, 4 for said length a greater than 300 mm and less than 500 mm, and 5 or more for said length a greater than or equal to 500 mm.

9. The panel-form loudspeaker of claim 6 wherein said edge strips used to reinforce the periphery of said laminated composite plate have different rigidities which are determined in a sound pressure level analysis to produce a desired distribution of natural normal modes with asymmetric deflected shapes for said laminated composite plate to reduce interference among sound waves radiated from different regions moving in opposite directions on said plate, in said sound pressure level analysis the thickness of said strips being selected to be less than 3 times the thickness of said laminated composite plate, widths of said strips less than one tenth of the width of said laminated composite plate, and elastic modulus of said strips less than or equal to elastic modulus in the fiber direction of said composite laminae.

10. The panel-form loudspeaker of claim 6 wherein the number and locations of said transducers, which are of electrodynamic transducers of moving-coil type, mounted in said rectangular feasible region on said laminated composite plate are determined using said method in accordance with claim 1 to achieve said desired spectrum of sound pressure level over said specific frequency range.

11. The panel-form loudspeaker according to claim 10 wherein the number of said transducers is one which is mounted at a specific location in said rectangular feasible region on said laminated composite plate with length a less than or equal to 400 mm to drive said plate to produce said desired sound pressure level spectrum over said specific frequency range, the specific location of said transducer in said rectangular feasible region being determined to make the variation of the distribution of said desired sound pressure level spectrum a minimum.

12. The panel-form loudspeaker of claim 10 wherein the number of said transducers is four which are mounted on the diagonal lines of said rectangular feasible region on said plate with length a greater than 400 mm and less than or equal to 1000 mm to drive said plate to produce said desired sound pressure level spectrum with minimum variation over said specific frequency range.

13. The panel-form loudspeaker of claim 10 wherein the number of said transducers is eight which are mounted axisymmetrically on the circumference of a circle sharing the same center with said rectangular feasible region in said rectangular feasible region on said plate with length a greater than 1000 mm and less than or equal to 2000 mm to drive said plate to produce said desired sound pressure level spectrum with minimum variation over said specific frequency range.

14. The panel-form loudspeaker of claim 10 wherein the number of said transducers is 16 which are mounted on the circumferences of two circles with different radii sharing the same center with the rectangular feasible region in said rectangular feasible region on said plate with length a greater than 2000 mm, half of said 16 transducers being positioned axisymmetrically on the circumference of said circle with larger radius and another half of said transducers being positioned axisymmetrically on the circumference of said circle with smaller radius.

15. The panel-form loudspeaker of claim 10 wherein at least one transducer is selected from said transducers of which the number is equal to or greater than 4 to serve as an active damper which produces motions of phase opposite to the phases of the motions generated by other transducers to damp out unwanted deflections of said laminated composite plate for producing a sound pressure level spectrum with minimum variation over said frequency range.

16. A panel-form loudspeaker comprising:

(a) a rectangular laminated composite plate with length a and width b peripherally stiffened by edge strips with different rigidities, said edge strips being used to make said laminated composite plate generate asymmetric natural vibrational mode shapes which are beneficial for sound radiation;

(b) at least one transducer positioned in a rectangular region with length $a/4$ and width $b/4$, which is concentric with said plate and has the sides with length $a/4$ parallel to the sides with length a of said plate, to drive said plate to produce a desired sound pressure level spectrum of which the average sound pressure level is maximized and the variation of sound pressure level distribution is minimized over a specific frequency range;

(c) a flexible suspension device comprising a long soft member with length equal to the perimeter of said edge-stiffened laminated composite plate used to surround and support the peripheral edges of said edge-stiffened laminated composite plate; and (d) a rectangular frame used to support said flexible suspension device.

* * * * *